United States Patent [19]

Asp

[11] 4,407,539

[45] Oct. 4, 1983

[54] LATCH FOR SLIDING GLASS DOOR

[76] Inventor: Ralph T. Asp, 4160 W. Walton, Drayton Plains, Mich. 48020

[21] Appl. No.: 297,094

[22] Filed: Aug. 28, 1981

[51] Int. Cl.[3] ..... E05C 17/12

[52] U.S. Cl. ..... 292/338; 292/DIG. 46

[58] Field of Search ..... 292/338, 339, DIG. 46, 292/DIG. 47, DIG. 49, DIG. 56

[56] References Cited

U.S. PATENT DOCUMENTS

| | | | |
|---|---|---|---|
| 913,833 | 3/1909 | Mallory | 292/338 |
| 1,110,628 | 9/1914 | Hendrix | 292/338 |
| 1,264,936 | 5/1918 | Huth | 292/DIG. 56 |
| 3,352,586 | 11/1967 | Hokanson | 292/225 |

FOREIGN PATENT DOCUMENTS

| | | | |
|---|---|---|---|
| 2048365 | 3/1980 | United Kingdom | 292/DIG. 56 |

*Primary Examiner*—Richard E. Moore

*Attorney, Agent, or Firm*—Harry R. Dumont

[57] ABSTRACT

A locking device for maintaining a sliding door in one of a number of locked positions along the length of its track. The locking device includes a spring-biased and pivotal lever having a toothed end urged toward a biting frictional contact with the track. The device is preferably mounted on the leading edge of the sliding door near its upper end for cooperative locking engagement with the upper track. The lever further includes a pair of bumpers mounted proximate its forward and rearward edges for providing a yieldable limit to the opening movement of the sliding glass door.

5 Claims, 3 Drawing Figures

LATCH FOR SLIDING GLASS DOOR

BACKGROUND OF THE INVENTION

This invention relates to a latch for sliding doors or windows by which it is possible to lock the moveable sliding door or window in any of a number of intermediate positions between fully open and closed. A number of prior art devices are known in which a limited number of open locked positions are possible by the use of locking pins in opposed holes. One such arrangement is shown in U.S. Pat. No. 3,779,588 issued to R. T. Raymon for "Sliding Panel Lock" on Dec. 18, 1973. The number of locked positions is quite limited in this system by nature of its structure.

A number of pivoted locking mechanisms having biting tooth portions are further known to restrain the movement of window relative to frame. Several such arrangements are shown in the prior art. U.S. Pat. No. 2,254,167 issued on Aug. 26, 1941 to W. C. Carpenter for "Window Catch" shows one pivotal biting type latch operable with vertically moveable windows.

U.S. Pat. No. 2,202,952 issued on June 4, 1940 to C. Z. Hayes for "Window Sash Fastener or Holder" discloses a still further type of pivotal catch used for latching a vertically moveable window.

Further arrangements are known for locking sliding glass doors against relative motion between it and the frame in which a projection and keeper are used for locking the door in its closed position. Such an arrangement likewise does not permit locking of the door in any of a large number of selected open positions which may be desired. One such arrangement of this type is shown in U.S. Pat. No. 3,830,534 issued on Aug. 20, 1974 to H. L. Pettrie et al. for "Lock for a Sliding Glass Door". It likewise does not prevent against "window lift" in the simple but effective manner of applicant's latch.

SUMMARY OF THE PRESENT INVENTION

The present invention will now be seen to include a novel and improved latch for a sliding door in which the locking lever is cooperable with the upper track in such manner, as to stop lateral movement of the sliding door from a selective locked position and further to prevent lifting the door up from the lower track to allow its removal and unauthorized entry. Bacause of the placement and structure of the locking device, if an intruder attempts to lift the sliding door out of the lower track, it will only serve to further and more securely latch the door in its locked position. The latch provides a constant and firm resistance against the upward movement of the entire window. In accordance with other features of the present invention, the locking pivotal lever can easily be flipped between a lower inactive and an upper active position. Bumpers are included at both the forward and rearward edges of the lever to prevent damage in event the window is pushed too far into the open position and further to allow the proper positioning of the lever in its locking position with respect to the upper track. The most effective locking forces are provided when there is substantial forward slating of the lever with regard to the forward edge and in which the tooth engagement of that lever is downwardly and rearwardly slanted relative to the track. A protective resilient rim is aligned with the teeth of the lever but raised above by the teeth when the latch is engaged.

BRIEF DESCRIPTION OF THE DRAWINGS

The invention will now be described with respect to the accompanying specification and the drawings in which like numerals are used for like elements that appear in the several different views and in which.

DETAILED DESCRIPTION OF THE PREFERRED EMBODIMENT

Figure 1:
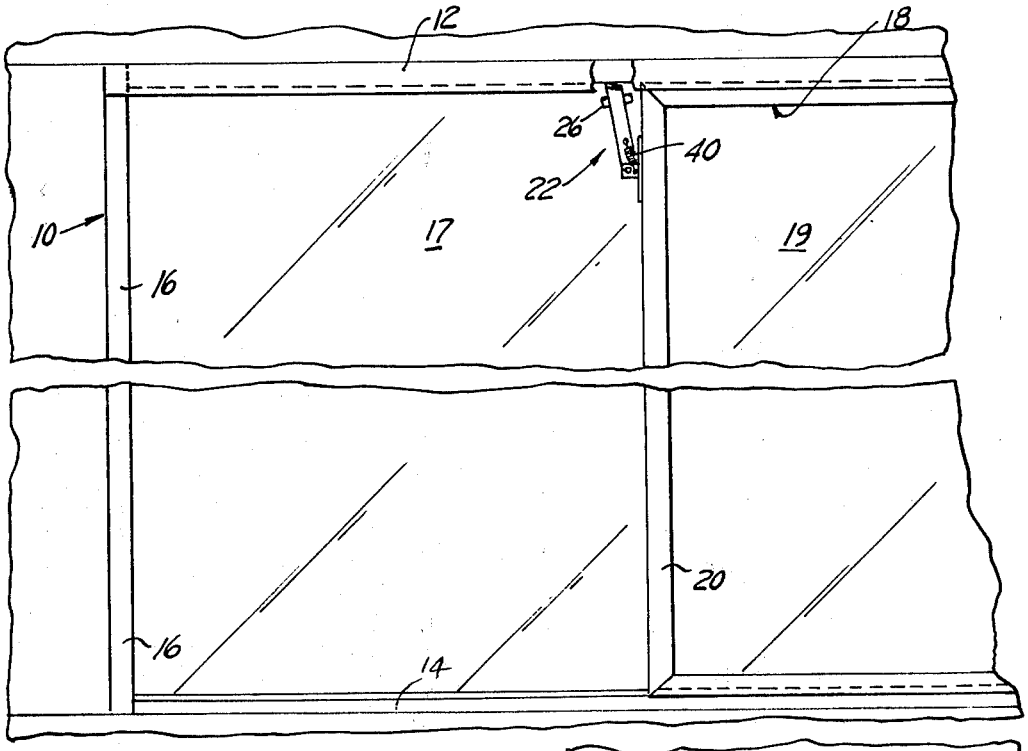
FIG. 1 is a view of a sliding door installation of the locking device with parts broken away.

FIG. 1 shows the stationary door 10 mounted at the left side of the window installation between the upper track 12 and a lower track 14. A frame member 16 and pane 17 complete the door together with a right hand vertical member, not shown. A moveable or sliding glass door 18 is mounted in the upper and lower tracks 12, 14 and includes a pane 19 and, at its left hand edge, a frame 20. The position of the moveable door 18 is shown in one of its intermediate locked positions. A locking device indicated generally by the numeral 22 is mounted on a plate 24 fixed to the forward and upper left hand edge of the frame member 20. A pivotal lever 26 is included in the locking device 22 as will be seen for a purpose and function that will be explained in greater detail in connection with FIGS. 2 and 3 hereinafter.

Figure 2:
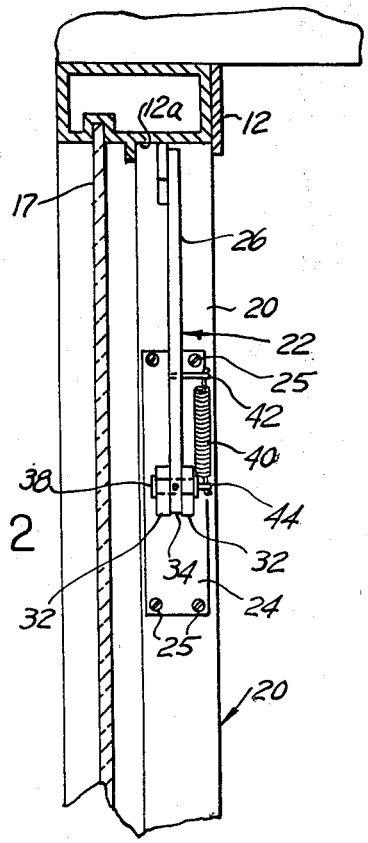
FIG. 2 is a partial sectional view showing the locking device in its mounted position on the forward edge of the frame of the sliding window.
Figure 3:
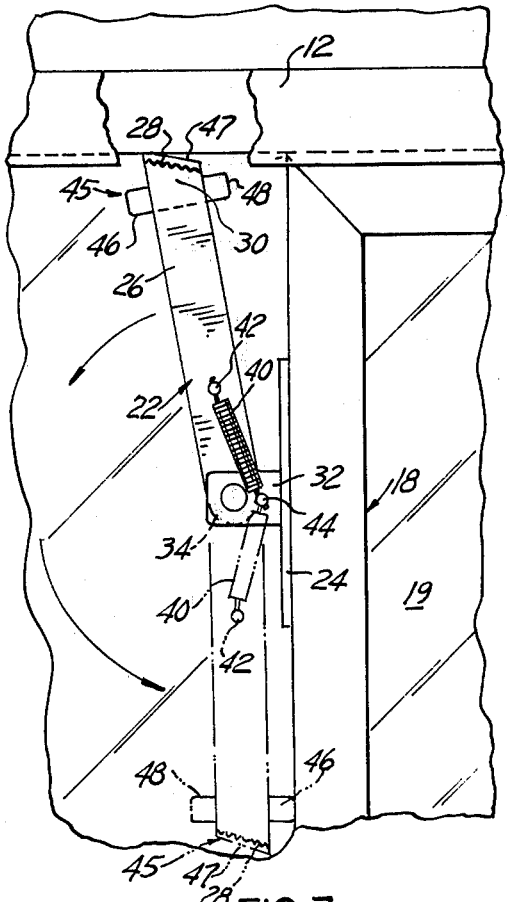
FIG. 3 is a fragmentary view of the window with the locking device shown moveable between its upward, active locking position shown in solid line and its lower inactive position shown in phantom line.

FIGS. 2 and 3 show the locking device 22 in its upwardly flipped locking position in which the upward toothed edge 30 with teeth 28 has been brought into abutment with the inner surface of the upper track 12. An outer resilient rim 47 is preferably mounted alongside the end of teeth 28 on the lever 26 to prevent damage to the inner surface of the upper track 12 by the teeth 28.

The mounting structure for the lever 26 shown at its lower end. The plate 24 is fixed to the frame member 20 by a set of threaded fasteners 25. Mounted on the plate 24 are a pair of outstanding arms 32 which support a lower hub 34 of the lever 26. Pivotal movement of the lever 26 around its hub 34 is provided through a pin 38 mounted between the two arms 32. A biasing spring 40 is further mounted between a pair of outstanding pins 42 and 44. The upper pin 42 is laterally outstanding from the lever 26 while the lower pin 44 is mounted on the outer surface of one of the two arms 32 extending forwardly from the plate 24. The lever 26 includes a first resilient bumper 46 at its left hand edge and a second resilient bumper 48 at its right hand or rearward edge. The two bumpers 46, 48 are preferably formed from a single molded piece that is attached to the upper end 30 of the lever 26. It will be seen that the bumpers exercise active functions in the operation of the locking mechanism as will further be explained in the section "Description of Operation" hereinafter.

While the description and present embodiment are directed to a sliding door arrangement, it will be understood that a like arrangement of parts and locking device functions in a highly satisfactory manner with a sliding window setup.

DESCRIPTION OF OPERATION

With the door 18 in a closed position, the locking device 22 is made functional by flipping the lever 26 in a clockwise direction to its upper solid line position as best indicated in FIG. 3. In that position, the spring 40 forces the upper serrations 28 past the protective rim 47 into firm biting engagement with the inner surface of the upper track 12. The engagement is a firm frictional engagement with damage to the track being prevented by the use of the rim 47 over the teeth 28.

It is further important to note that in the locked position of the lever 26, if force is applied in an opening direction against the sliding door 18, the teeth 28 will be driven even more securely into locking engagement with the upper track 12.

A favorite trick of burglars or other intruders is to try to pry open the sliding door so that it may be raised up out of the lower track and removed to permit entry. The present locking device by reason of its positioning and parts resists the upward movement of the sliding window from the track and makes removal of the window by force not possible. Attempts to raise the window make it increasingly difficult to slide the window open.

Attention also must be given to the function of the two bumpers 46, 48 that are mounted on the leading and following edges of the upper end 30 of lever 26, respectively. In the lower storage position of the locking device as shown in FIG. 3, the bumper 48 is forwardly oriented in the direction of the left hand frame member 16, to prevent damage if the window should be slid too far open.

In the raised and active position of the locking device shown in solid line, the bumper 48 plays a different function namely that of preventing damaging contact between the right hand edge of the lever 26 and the forward edge of the door 18. As shown in FIGS. 1 and 3, for most effective locking engagement the lever 26 should be positioned in a somewhat forwardly inclined direction.

The other bumper 46 fixed to the leading edge of the lever 26 serves to hold the lever 26 somewhat spaced from the forward edge of the moveable sliding door and it protects the device when flip-over is made between the upper active and the lower inactive position of the locking device.

It will thus be seen that I have provided by my invention, a new and improved locking device for sliding glass doors that permits locking of the door in any of a number intermediate open positions and further guards against the door being raised from the track in an attempted entry.

I claim:

1. A locking device for a sliding door mounted in a track comprising:

a pivotal lever mounted on the upper forward edge of the sliding door, said lever pivotal between an active upper locking position and a lower inactive position, said lever further having an upper toothed end portion engageable with the opposed track in its upper locking position;

a biasing spring operably connected to said lever for maintaining it in one of said positions; and a resilient molded member mounted at the upper end of said lever, said member including a forward and a rearward bumper, said molded member including a further protective rim alongside and slightly above said toothed portion.

2. The combination as set forth in claim 1 wherein said toothed portion includes a plurality of teeth formed in a slanted group on the lever and portion.

3. The combination as set forth in claim 1 wherein said biasing-spring is connected to said lever in an over-center operating position.

4. The combination as set forth in claim 1 wherein said lever has its lower end pivotally mounted on a pair of arms, said arms extending from a plate fastened to the forward edge of said sliding door.

5. The combination as set forth in claim 4 wherein said plate is fastened to said forward edge by a plurality of threaded fasteners.

* * * * *